US005178305A

United States Patent [19]

Keller

[11] Patent Number: 5,178,305

[45] Date of Patent: Jan. 12, 1993

[54] DISPENSING CARTRIDGE WITH STORAGE CYLINDER AND DISPENSING PISTON HAVING A CLOSURE SEALED VENT BORE

[76] Inventor: Wilhelm A. Keller, Obstgartenweg 9, CH - 6402 Merlischachen, Switzerland

[21] Appl. No.: 717,921

[22] Filed: Jun. 20, 1991

[30] Foreign Application Priority Data

Jun. 21, 1990 [CH] Switzerland ..... 02079/90

[51] Int. Cl.[5] ..... B67D 5/42; B65B 7/28

[52] U.S. Cl. ..... 222/386; 92/181 P

[58] Field of Search ..... 222/386, 386.5, 389; 604/125; 92/181 P

[56] References Cited

U.S. PATENT DOCUMENTS

| | | | |
|---|---|---|---|
| 4,657,161 | 4/1987 | Endo et al. | 222/383 X |
| 4,792,065 | 12/1988 | Soehnlein et al. | 222/386 X |
| 4,819,836 | 4/1989 | Meckenstock | 222/386 |
| 5,000,355 | 3/1991 | Pritchard | 222/386 X |

FOREIGN PATENT DOCUMENTS

| | | | |
|---|---|---|---|
| 344491 | 12/1989 | European Pat. Off. | 222/386 |
| 351517 | 1/1990 | European Pat. Off. | 222/386 |
| 3435576 | 4/1986 | Fed. Rep. of Germany | 222/386 |
| 2626248 | 1/1988 | France . | |
| WO9005096 | 5/1990 | PCT Int'l Appl. . | |

*Primary Examiner*—Andres Kashnikow
*Assistant Examiner*—Kenneth DeRosa
*Attorney, Agent, or Firm*—Ostrolenk, Faber, Gerb & Soffen

[57] ABSTRACT

The dispensing cartridge comprises a storage cylinder and a dispensing piston whose bottom surface is progressively recessed from the piston edge towards an aeration bore. An overflow chamber is disposed around said aeration bore, overflow slots being provided in the wall which forms said aeration bore. Said aeration bore is sealed by a closure whose peg portion extends into said bore and whose head is provided with a surrounding bead which snaps into a corresponding annular groove in the outer wall of said overflow chamber. Such a cartridge prevents a disturbing effect of the material flowing out when the dispensing piston is inserted, and during the aeration procedure.

5 Claims, 2 Drawing Sheets

DISPENSING CARTRIDGE WITH STORAGE CYLINDER AND DISPENSING PISTON HAVING A CLOSURE SEALED VENT BORE

The present invention refers to a dispensing cartridge with a storage cylinder and a dispensing piston whose bottom surface facing the cartridge contents is progressively recessed towards an air evacuation bore, said evacuation bore being sealed by a closure. Such a dispensing cartridge is known from European Patent Application No. EP-A-344 491 in the name of the applicant. At the time, this known dispensing cartridge represented a progress over the prior art, but tests nave shown that this cartridge is improvable as well. In particular, it has been found that when filling in relatively liquid materials, these materials remain on the backward surface of the dispensing piston after the air evacuation and may lead to soiling. Thus it is the object of the present invention to improve this dispensing cartridge in such a manner that the material which flows out during the advance of the dispensing piston and the closure of the air evacuation bore cannot disturb anymore and that a quicker and simpler closure is provided. This object is attained by means of a dispensing cartridge wherein an overflow chamber is disposed around said aeration bore, said overflow chamber being sealed by said closure as well.

The invention is explained in more detail hereinafter with reference to a drawing of an embodiment.

Figure 1:
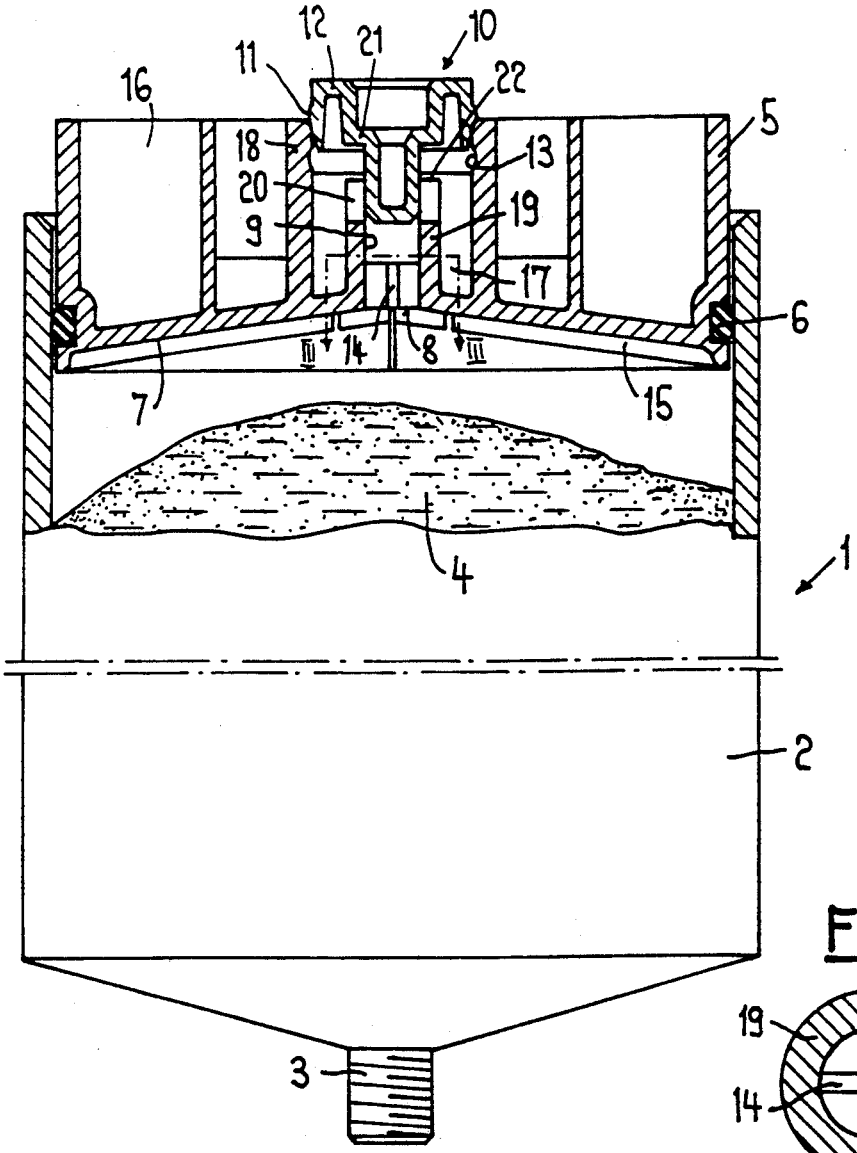
FIG. 1 shows a sectional view of a dispensing cartridge according to the invention as the dispensing piston is inserted.

FIG. 1 illustrates the dispensing cartridge 1 with its storage cylinder 2, which is closed at the bottom by a closable nozzle 3. In FIG. 1, cylinder 2 already contains a precisely weighed quantity of filling material 4. A dispensing piston 5 runs inside cylinder 2, said piston comprising an O-ring 6 which is sunk in its wall for the purpose of tightness. Generally, said dispensing piston is made of a dimensionally stable material. Instead of an O-ring, a resilient sealing lip may be provided which is integrally formed on the piston edge and abuts against the inner wall of the cylinder. The contents of the cartridge are stored in the storage cylinder and subsequently extruded through the nozzle for use. It is important when filling the cylinder or introducing the dispensing piston that all air under the bottom surface 7 of the dispensing piston may escape regardless of the viscosity of the filling material 4 or of its surface structure. Therefore, said bottom surface facing the cartridge contents is continuously slanted from the piston edge to its center. The deepest point 8 of the bottom surface 7 extends into an aeration bore 9 which leads through the piston to the exterior.

Figure 2:
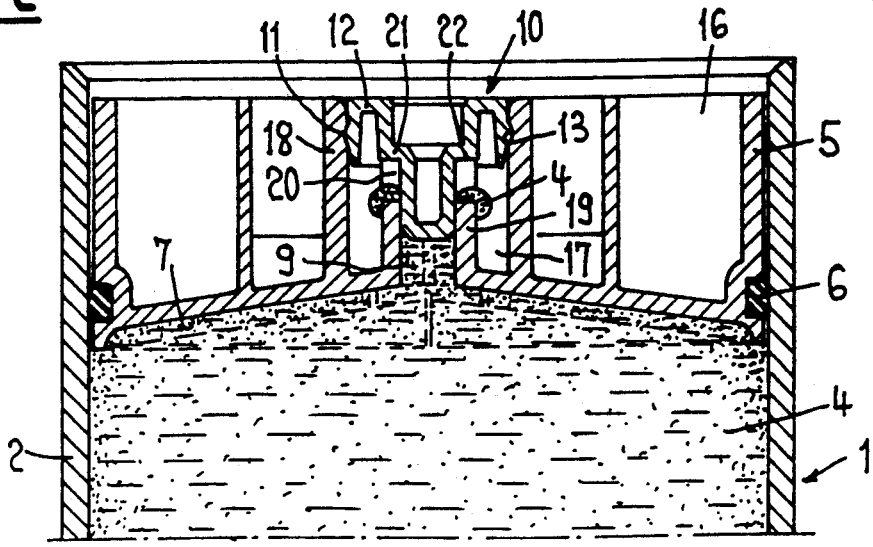
FIG. 2 shows the inserted dispensing piston in its initial position before the dispensing operation.
Figure 4:
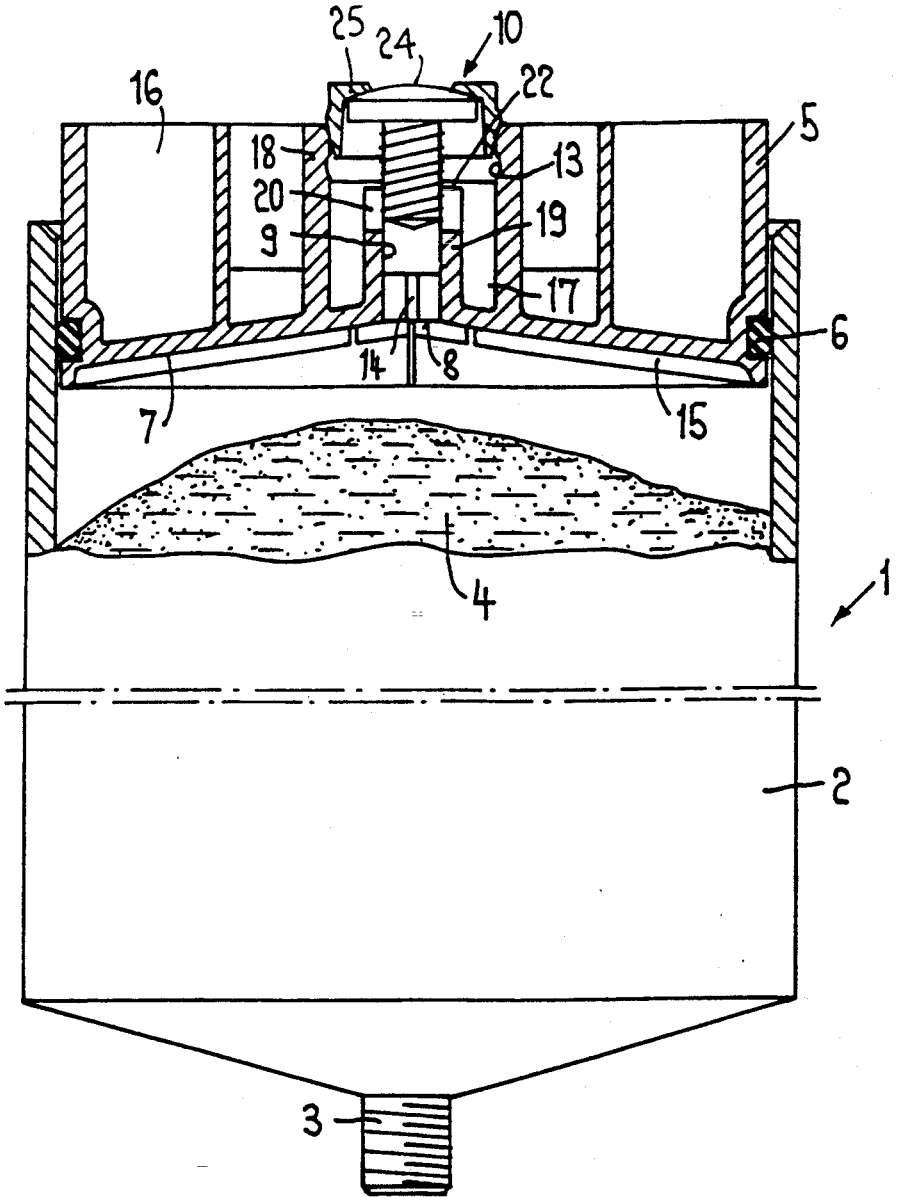
FIG. 4 shows a sectional view of a dispensing cartridge according to the invention in which a screwed sealing plug is used as the closure element.
Figure 5:
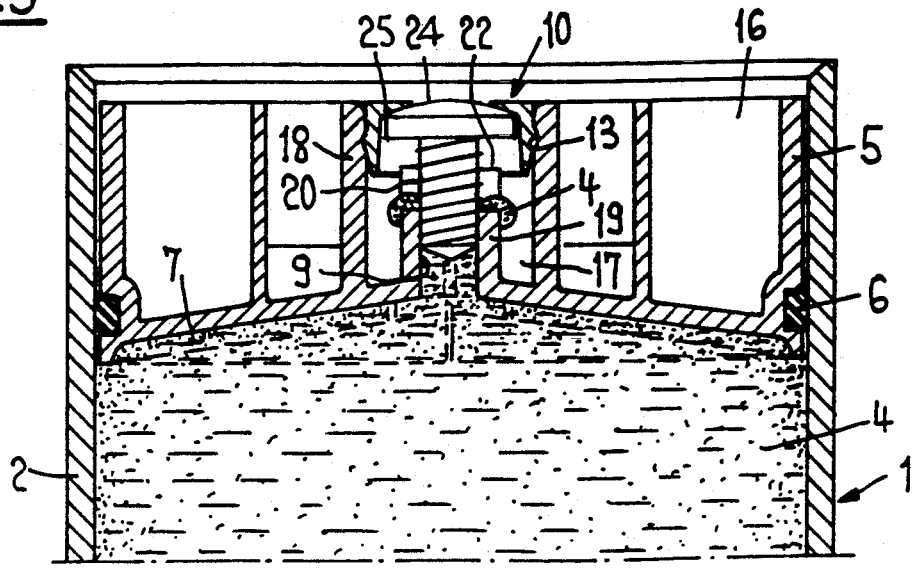
FIG. 5 shows the screwed sealing plug in the closed position.

Bore 9 is closed by a closure 10 which in the present example, see FIG. 2, snaps into an annular groove 13 by means of a bead 11 on the head 12 of said closure, said bead being supported by a resilient collar which provides a contact pressure of the bead inside annular groove 13.

Figure 3:
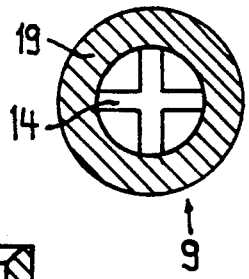
FIG. 3 shows a sectional view according to line III—III in FIG. 1.

Aeration bore 9 comprises, as appears in FIG. 3, a contraction of its cross-section over a certain height as seen from the bottom surface, e.g. in the form of a cross-shaped slot 14, said contraction serving as a throttle against a quick outflow of the filling material after the filling process is completed. A complete air evacuation is thereby guaranteed. Said slots, respectively interior grooves, may of course have a different configuration and a different number.

Further, said bottom surface of the piston is provided with a number of radially extending, slot-shaped recesses 15 which run into the aeration bore. Moreover, the piston can be provided above its bottom surface with radial ribs 16. These radially extending, slot-shaped recesses 15 as well as the ribs 16 are described and illustrated in full detail in the above-mentioned patent application.

In the above-mentioned solution, the filling material flows over the rim of the sealing surface which is referenced as 19 there during the advance of the piston and may cause soiling because said sealing material remains on the surface of the dispensing piston. In order to prevent any disturbing effects of the filling material, a venting chamber 17 is disposed around cylindrical aeration bore 9, said chamber being formed by a surrounding sealing cylinder 18 which is disposed at a distance from wall 19 which forms the cylindrical aeration bore 9, and in the inner surface of which annular groove 13 is formed. The wall 19 which forms the aeration bore is provided with slots 20 through which the filling material can flow out, as is illustrated in FIG. 2.

The filling material can be filled in e.g. from below through the open nozzle 3, the exact volume of said material being determined by a dosing device. Nozzle 3 is subsequently closed. The dispensing piston is then inserted into the cylinder from above and pressed down against the filling material until all air below the piston bottom has escaped through the aeration bore and the throttle. Complete aeration can be observed optically, and it is obtained when the filling material flows out through the slots 20 of wall 19. Afterwards, closure 10 is pressed in until its bead 11 snaps into annular groove 13 and shoulder 21 of the closure rests upon front face 22 of wall 19. During the insertion of the piston and of the closure, a small amount of the filling material in the area of slots 20 is pressed into the overflow chamber. In the position shown in FIG. 2, the dispensing cartridge is ready for a precise dispensing of the filling material.

Of course, the filling material may also be filled in from the side of the dispensing piston while nozzle 3 is closed, depending on the filling system and the dosing devices. Instead of the illustrated and described closure 10, a screwed sealing plug 24 with a similar configuration as in the above-mentioned specification could be used, however comprising a head 25 to seal off the overflow chamber.

I claim:

1. A dispensing cartridge with a storage cylinder and a dispensing piston whose bottom surface facing the cartridge contents is progressively recessed towards an air evacuation bore, said evacuation bore having a wall and being sealed by a closure, wherein said wall is provided with overflow slots leading from said evacuation bore to an overflow chamber which is disposed around said evacuation bore, said overflow chamber being sealed by said closure as well, wherein said closure comprises a peg portion which moves into said bore when said closure is moved from an open position to a closed position, and a head having a surrounding bead which, in the closed position, snaps into an annular groove in an outer wall of said overflow chamber, and wherein said evacuation bore is provided with a progressively contracting cross-section in a direction away from said storage cylinder, said progressively contracting cross-section terminating in a cross-slot so as to throttle flow of material therethrough.

2. The dispensing cartridge of claim 1, wherein said surrounding bead is connected to said head by a resilient collar.

3. The dispensing cartridge of claim 1, wherein said bottom surface of said dispensing piston is provided with radially extending slot-shaped recesses which run into said evacuation bore.

4. A dispensing cartridge with a storage cylinder and a dispensing piston whose bottom surface facing the cartridge contents is progressively recessed towards an air evacuation bore, said evacuation bore having a wall and being sealed by a closure, wherein said wall is provided with overflow slots leading from said evacuation bore to an overflow slots disposed around said evacuation bore, said overflow chamber being sealed by said closure as well, wherein said closure comprises a screwed sealing plug which moves into said bore and has a head which seals off said overflow chamber when said closure is moved from an open position to a closed position, and wherein said evacuation bore is provided with a progressively contracting cross-section in a direction away from said storage cylinder, said progressively contracting cross-section terminating in a cross-slot so as to throttle flow of material therethrough.

5. The dispensing cartridge of claim 4, wherein said bottom surface of said dispensing piston is provided with radially extending, slot-shaped recesses which run into said evacuation bore.

* * * * *